US005178202A

United States Patent [19]

Dannoura et al.

[11] Patent Number: 5,178,202

[45] Date of Patent: Jan. 12, 1993

[54] METHOD AND APPARATUS FOR CASTING ENGINE BLOCK

[75] Inventors: Sadayuki Dannoura; Hironori Yoshizu; Tadaaki Higuchi; Takashi Saito, all of Yamaguchi, Japan

[73] Assignee: Ube Industries, Ltd., Japan

[21] Appl. No.: 721,083

[22] Filed: Jun. 24, 1991

[30] Foreign Application Priority Data

Jun. 28, 1990 [JP] Japan ..... 2-168252

[51] Int. Cl.[5] ..... B22D 17/12; B22D 19/08

[52] U.S. Cl. ..... 164/112; 164/113; 164/334; 164/312; 164/520

[58] Field of Search ..... 164/113, 457, 312, 98, 164/112, 332, 333, 334, 520

[56] References Cited

U.S. PATENT DOCUMENTS

| | | |
|---|---|---|
| 4,001,468 | 1/1977 | Skubon et al. . |
| 4,088,178 | 5/1978 | Ueno et al. . |
| 4,096,293 | 6/1978 | Skubon et al. . |
| 4,252,177 | 2/1981 | Ueno et al. . |
| 4,269,758 | 5/1981 | Richard . |
| 4,413,666 | 11/1983 | Page . |
| 4,489,771 | 12/1984 | Takeshima et al. . |
| 4,529,028 | 7/1985 | Dybala et al. . |
| 4,538,666 | 9/1985 | Takeshima et al. . |
| 4,760,874 | 8/1988 | Mihara . |
| 4,782,886 | 11/1988 | Uchida et al. . |
| 4,942,917 | 7/1990 | Koch et al. . |
| 4,981,168 | 1/1991 | Koch et al. . |

FOREIGN PATENT DOCUMENTS

| | | | |
|---|---|---|---|
| 3032592 | 3/1982 | Fed. Rep. of Germany | 164/520 |
| 58-13264 | 3/1983 | Japan . | |
| 59-4957 | 1/1984 | Japan . | |
| 59-76654 | 5/1984 | Japan | 164/457 |
| 61-144257 | 7/1986 | Japan . | |
| 61-180661 | 8/1986 | Japan . | |
| 61-180664 | 8/1986 | Japan . | |
| 63-11096 | 3/1988 | Japan . | |
| 1-40709 | 8/1989 | Japan . | |
| 2-15305 | 4/1990 | Japan . | |
| 2-23261 | 5/1990 | Japan . | |
| 2169229 | 7/1986 | United Kingdom | 164/113 |

*Primary Examiner*—Kuang Y. Lin

*Attorney, Agent, or Firm*—Blakely, Sokoloff, Taylor & Zafman

[57] ABSTRACT

In a method and apparatus for casting an engine block, a core holding portion located below an open upper mold located above a lower mold fixed on a stationary platen is caused to hold a water jacket formation destructive core surrounding a cylinder bore formation portion. Slide molds divided in a circumferential direction, located between the upper mold and the lower mold, and supported by the upper mold to be opened/closed in a horizontal direction is closed. Mold clamping is performed upon downward movement of the upper mold. A molten metal is injected at a high casting pressure of not less than 300 kg/cm$^2$ from a molten metal injection sleeve open to a portion at which the lower mold is brought into direct contact with the upper mold.

19 Claims, 12 Drawing Sheets

METHOD AND APPARATUS FOR CASTING ENGINE BLOCK

BACKGROUND OF THE INVENTION

The present invention relates to a method and apparatus for casting with an aluminum alloy or the like an engine block for an automobile or the like having a plurality of cylinders arranged in, e.g., tandem with each other.

In an engine block, a water jacket serving as a space for flowing cooling water is formed in an peripheral portion of a cylinder bore at a position slightly spaced from the cylinder bore.

Open and closed deck engine blocks are prepared in accordance with different water jacket formation techniques. In the open deck engine block, the upper surface of a water jacket is entirely open at a head cover contact surface of the upper surface of the engine block. In the closed deck engine block, although the interior of a water jacket is continuous along the entire periphery, the upper surface of the water jacket is partially open at a plurality of locations at the head cover contact surface. That is, bridge portions which connects opposite sides of the water jacket are respectively formed at the plurality of locations of the upper surface of the water jacket.

Open deck engine blocks have been conventionally employed. In this case, a normal metal core can be used to form a space serving as the water jacket. No problem is posed to form the water jacket, and formation can be facilitated. In the open deck engine block, since the entire periphery of the upper surface of the water jacket is open, problems on the strength and deformation of the engine block itself are posed. As a result, in order to solve these problems, the wall thickness of the engine block must be increased, the overall weight of the engine must be increased, and fuel consumption is undesirably increased.

In recent years, the closed deck engine block has received a great deal attention. Some manufacturers attempt to manufacture closed deck engine blocks.

The closed deck engine block is said to be excellent in strength and against deformation as compared with the open deck engine block. Since the plurality of bridge portions as closed portions are formed at upper surface portions of the water jacket, a metal core cannot be used, unlike in a conventional technique. A destructive core is used in place of this metal core because the destructive core can be destructed and removed upon casing of the engine block. Although a sand core, a salt core, and the like may be used as destructive cores, the sand core is most popular.

A sand core cannot be simply used to form a water jacket serving as a space in an engine jacket.

The engine block particularly requires a high strength and durability, and any cavity must not be formed therein. As has been attempted in these days, when an engine block is made of a light alloy such as an aluminum or magnesium alloy in place of cast iron in favor of a lightweight structure, a fine product without any cavity is required. For this reason, a casting method free from formation of cavities is required, and high-pressure casting is also required. Formation of molten metal solidified pieces called burrs on separation and sliding surfaces of the molds during casting must be minimized. Even if burrs are formed, they must be easily removed so that they do not interfere with the next casting cycle.

On the other hand, when a molten metal is to be injected into the molds at a high pressure, the sand core must not be deformed, destructed, or cracked. After casting, the sand core must be destructed, and all the sand must be easily and properly removed from the cast engine block. For this purpose, a special-purpose sand core must be employed. Special care must be taken for casting, and special implementations must be provided in a casting apparatus. When a sand core is deformed during casting, a hole formed in a water jacket of an engine block is deformed, a thin-walled portion is formed in a thick wall of the engine block to degrade the strength and durability and cause cooling water leakage. In addition, when the sand core is destructed or cracked during casting, the product itself becomes defective. After casting, if all the sand cannot be removed, and sand is removed from the engine block during its use, the sand flows through a cooling water circuit, thereby adversely affecting operations of a cooling water pump and its valve and causing, in the worst case, operation failures.

In an existing engine block, a cast iron cylinder liner is mounted in the peripheral surface of the cylinder bore. In the near future, a cylinder liner may not be used due to a material improvement.

When an engine block is cast using a cylinder liner, before and during casting, a special implementation must be provided to mount a cylinder liner in part of a mold. More specifically, when a cylinder liner is mounted in and held by part of the mold, the cylinder liner must be smoothly mounted in the mold, as a matter of course. Cracking of the sand core and its partial damage, caused by a shock or the like during mounting of the cylinder liner in the mold must be prevented.

A conventional apparatus for casting an engine block of this type is disclosed in Japanese Patent Laid-Open No. 61-180661. This casting apparatus comprises a lower mold fixed on a stationary platen. An upper mold which is supported on a movable platen and lifted together with the movable platen by a mold clamping cylinder is arranged above the lower mold. A plurality of slide molds which are divided in the circumferential direction and are opened/closed by opening/closing cylinders upon radially horizontal movement are supported on the lower mold side. A plurality of blocks having an almost semicircular section and arranged in tandem with each other in the longitudinal direction of the lower mold extend from the lower mold at a contact portion of the closed slide molds. Arcuated portions for forming a cavity corresponding to a crank case, together with the blocks during mold closing, are formed in the lower halves of the slide molds. A destructive sand core obtained by connecting four cylinders in tandem with each other extends upward from and supported on the upper ends of the blocks. Four columnar members on which cylinder liners are fitted are suspended from the upper mold in correspondence with the cylindrical portions of the sand core. The stationary sleeve formed on the lower mold and communicating with an injection sleeve communicates with the cavity corresponding to the crank case and the cavities formed on both sides of the sand core during clamping between the upper mold and the slide molds. A plurality of temporary setting pins for holding the sand core are formed on the lower mold so as to extend upward from pin holes of the blocks by means of springs and the like.

With the above arrangement, the sand core is placed on the temporary setting pins slightly extending from the blocks between the molds. In this state, the slide molds are closed to insert skirt portions as a plurality of projections formed on the outer side surface of the sand core into core holding holes formed inside the slide molds, thereby holding the sand core. Thereafter, the temporary setting pins are retracted into the blocks. The upper mold is moved downward by the mold clamping cylinder and is urged against the lower mold. The four columnar members suspended from the upper mold are moved downward together with the cylinder liners and inserted into the sand core cylindrical portions which support the skirt portions. Before the slide mold and the upper mold are clamped against each other, a molten metal is injected from an injection sleeve also serving as the stationary sleeve in which the molten metal is charged in advance. The cavity corresponding to the crank case which communicates with the injection sleeve and the cavities contacting both surfaces of the sand core are filled with the molten metal, and the molten metal is solidified. When the upper mold and the slide molds are opened, and the push pins mounted on the upper mold are extended, the product solidified in the cavity, i.e., the engine block is released from the molds. Thereafter, when the sand core in the engine block serving as a product is destructed, the sand core is removed in the form of small destructed pieces. A cooling water circulating jacket serving as a space can be formed.

In the conventional engine block casting apparatus described above, however, each slide mold is supported on the lower mold and is horizontally reciprocated while sliding along the upper surface of the lower mold located near a casting side on which a high-temperature molten metal is injected. The molten metal enters into a gap between the slide molds and the lower mold to tend to form burrs. These burrs cannot be easily removed, and the slide molds will not move, thus interrupting a casting operation. In addition, the molten metal inserted into the above gap leaks outside the molds to endanger workers. In addition, the amount of molten metal becomes short, thus degrading product quality.

If the burr is present between sliding surfaces, i.e., the lower surfaces of the slide molds and the upper surface of the lower mold, it is difficult to release the product from the molds. When the slide mold is open and when the burr is left on the upper surface of the lower mold or a burr is dropped from the above, the bur cannot be perfectly eliminated to the outside of the casting apparatus even by air blowing due to the presence of the slide molds. In addition, since a fresh high-temperature molten metal injected from the injection sleeve is brought into direct contact with the lower surfaces of the slide molds, a heat check occurs in each slide mold, and the slide molds will not open. In addition, since the lower surfaces of the slide molds are always in contact with the upper surface of the lower mold, the lower surface of each slide mold cannot be sprayed, or externally cooled or cleaned, resulting in inconvenience.

In the conventional casting apparatus, since the skirt portions are used to hold the scan core in the slide molds, a molded body has holes corresponding to the skirt portions. Therefore, these holes must be embedded with an aluminum alloy or the like after the sand core is removed.

When the engine block is to be cast using the sand core, as described above, the sand core must have a sufficiently high strength so as to prevent its destruction and deformation during casting of the molten metal at a high pressure. At the same time, after casting, when the product is to be released from the molds and the sand core is to be removed, all the sand must be easily and properly removed. For this purpose, special binders may be mixed in the sand, or a special coating may be formed on the surface of the sand core.

During high-temperature casting, gases may be produced from these binders or the like. In addition, air and a gas as of a mold release agent are also present in the mold cavity. If these gases are not sufficiently removed outside the molds at the time of casting, a cavity may be formed in a product, and the sand core is destructed or damaged during casting using the molten metal. When a small amount of gas is left in the mold cavity and is not sufficiently discharged during casting and is moved to a corner of the mold cavity, this gas is heat-insulatively compressed by the behavior of the molten metal. The mold portion corresponding to the compressed gas is set at an extremely high temperature. For example, although an aluminum alloy subjected to casting has a melting temperature of about 700° C., the gas has a high temperature of 1,000° C. or more by heat-insulative compression. By this high temperature, a binder in a sand core is thermally decomposed to produce a gas. At the same time, a degree of bond of the sand particles is decreased to cause the drawbacks described above.

When casting using a special sand core, as in this engine block, must be performed at a high pressure, discharge of gases is one of the most important problems to be solved.

When a large, complicated cast product requiring high quality and a high strength, as in an engine block, is to be cast, only a fresh, high-quality molten metal must always be used. Injection of a solidified component of the molten metal must be minimized as much as possible. For this purpose, the molten metal must be quickly cast.

The present invention has been made in consideration of this point, too.

SUMMARY OF THE INVENTION

It is an object of the present invention to provide a method and apparatus for casting an engine cylinder, which can prevent an opening/closing failure of slide molds and can smoothly perform a casting operation.

It is another object of the present invention to provide a method and apparatus for casting an engine cylinder, capable of performing uniform injection of a molten metal in the respective portions of a mold cavity.

It is still another object of the present invention to provide a method and apparatus for casting an engine cylinder having a high-quality, high-strength engine block.

It is still another object of the present invention to provide a method and apparatus for casting an engine cylinder, capable of casting a molten metal at a high pressure by using an easy-to-remove destructive core having a sufficiently high strength.

It is still another object of the present invention to provide a method and apparatus for casting an engine cylinder, which can prevent formation of a cavity caused by a gas in a cavity and damage to the destructive core.

It is still another object of the present invention to provide a method and apparatus for casting an engine cylinder, capable of completing casting in the mold cavity before the molten metal is solidified.

It is still another object of the present invention to provide a method and apparatus for casting an engine cylinder, capable of easily and properly holding a cylinder liner in the molds.

In order to achieve the above objects of the present invention, there is provided a method of casting an engine block, comprising the steps of causing a core holding portion located below an open upper mold located above a lower mold fixed on a stationary platen to hold a water jacket formation destructive core surrounding a cylinder bore formation portion, closing slide molds which are divided in a circumferential direction, are located between the upper mold and the lower mold, and are supported by the upper mold to be opened/closed in a horizontal direction, performing mold clamping upon downward movement of the upper mold, and injecting a molten metal, at a high casting pressure of not less than 300 kg/cm$^2$, from a molten metal injection sleeve open to a portion at which the lower mold is brought into direct contact with the upper mold.

In order to achieve the above objects of the present invention, there is also provided an apparatus for casting an engine block, comprising a lower mold fixed on a stationary platen, an upper mold located above the lower mold, supported by a movable platen, and vertically moved together with the movable platen, slide molds located between the upper mold and the lower mold, divided in a circumferential direction, opened/closed in a horizontal direction, and arranged to be slidable on the upper mold, a vertical casting injection unit for injecting a molten metal in a mold cavity, a destructive core held in a core holding portion arranged below the upper mold, and an injection sleeve open to a portion at which the lower mold is brought into direct contact with the upper mold.

BRIEF DESCRIPTION OF THE DRAWINGS

FIGS. 1 to 8*e* show an engine block casting apparatus according to an embodiment of the present invention, in which FIG. 1 is a partially cutaway sectional front view of the engine block casting apparatus, FIG. 2 is a sectional view showing a mold assembly, FIG. 3 is a longitudinal sectional view of the mold assembly along its longitudinal direction in FIG. 2, FIG. 4 is an enlarged longitudinal sectional view showing the mold assembly shown in FIG. 2, FIG. 5 is a perspective view of a sand core, FIG. 6 is a cross-sectional view of an engine block, FIG. 7 is a plan view of the engine block, and FIGS. 8*a* to 8*e* are longitudinal views showing the casting apparatus so as to explain its operations;

DESCRIPTION OF THE PREFERRED EMBODIMENT

Figure 1:
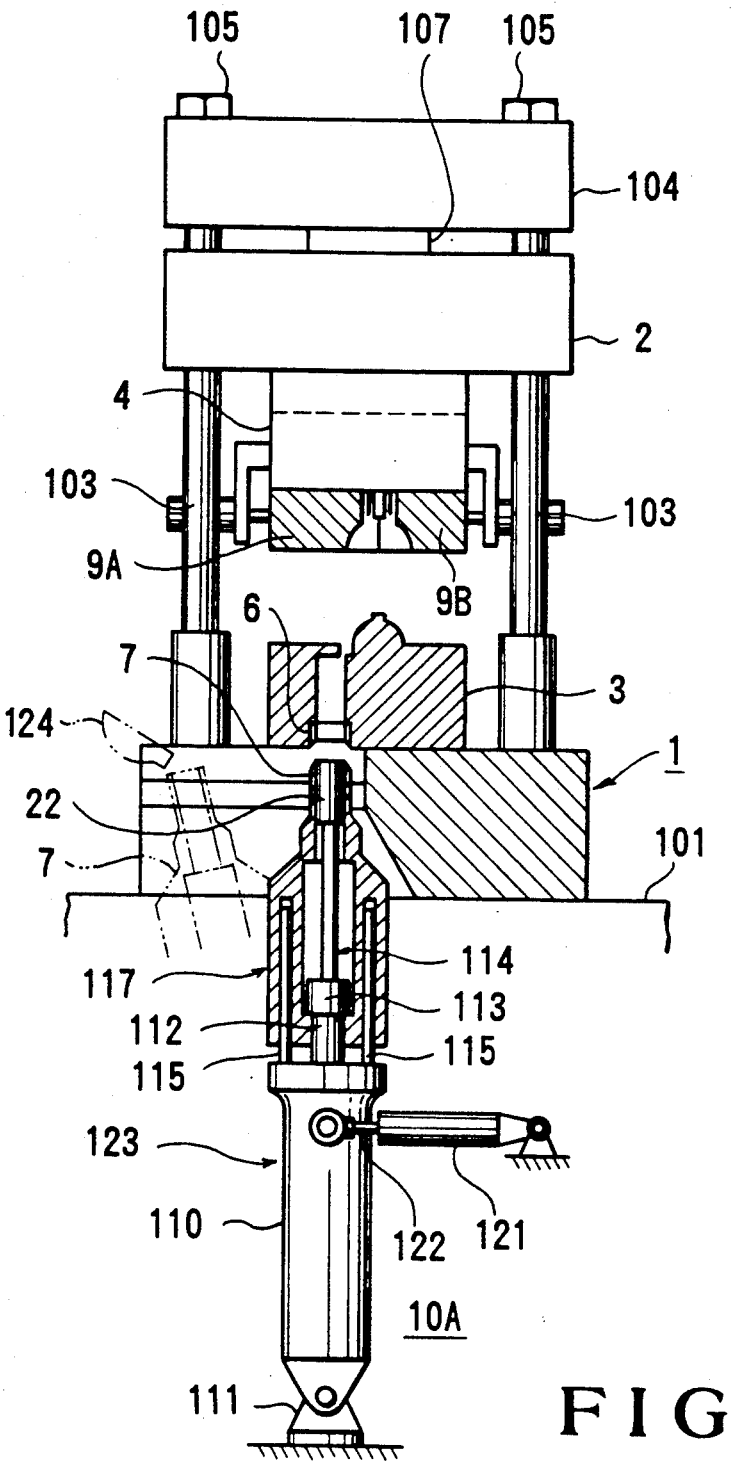
Figure 2:
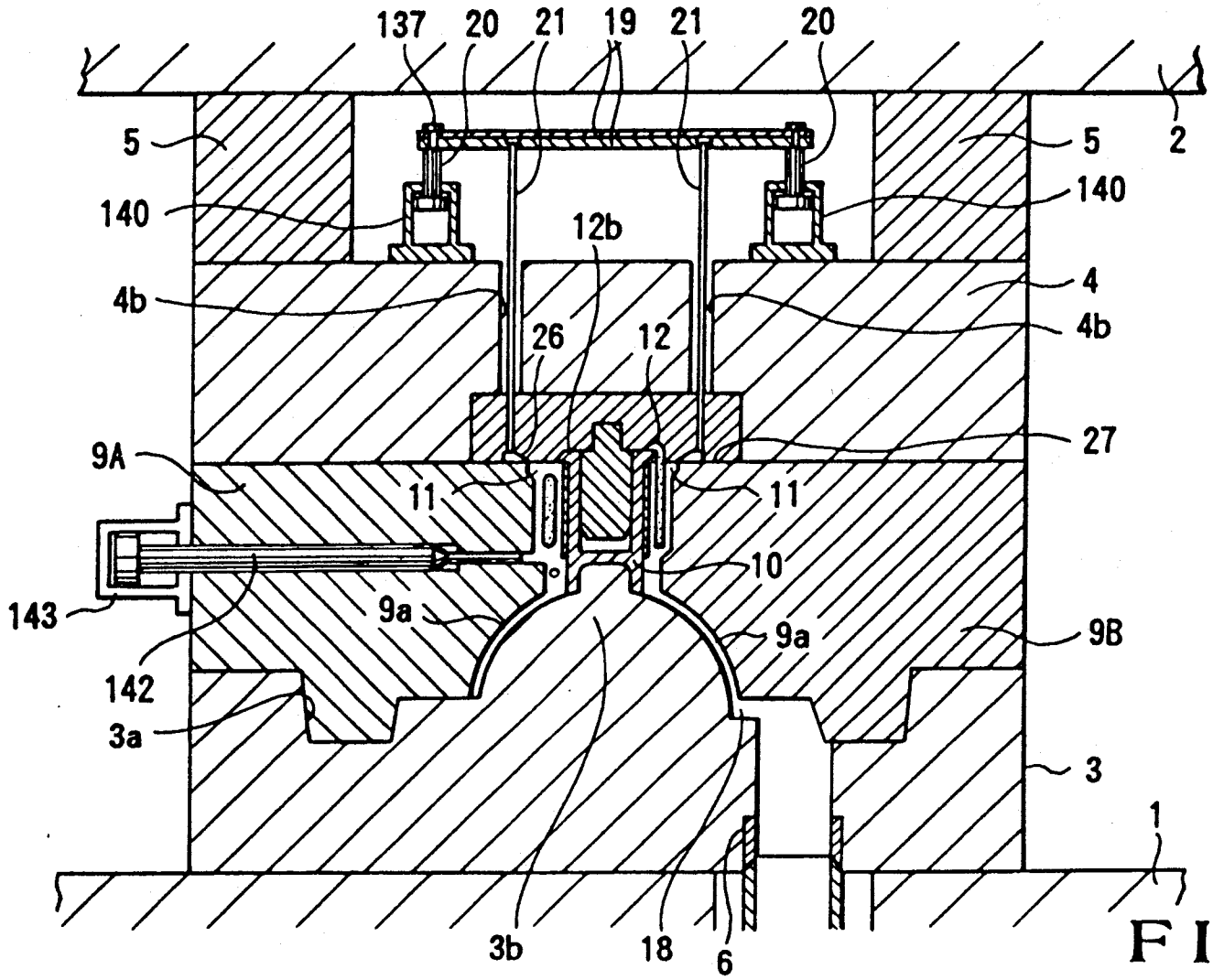
Figure 3:
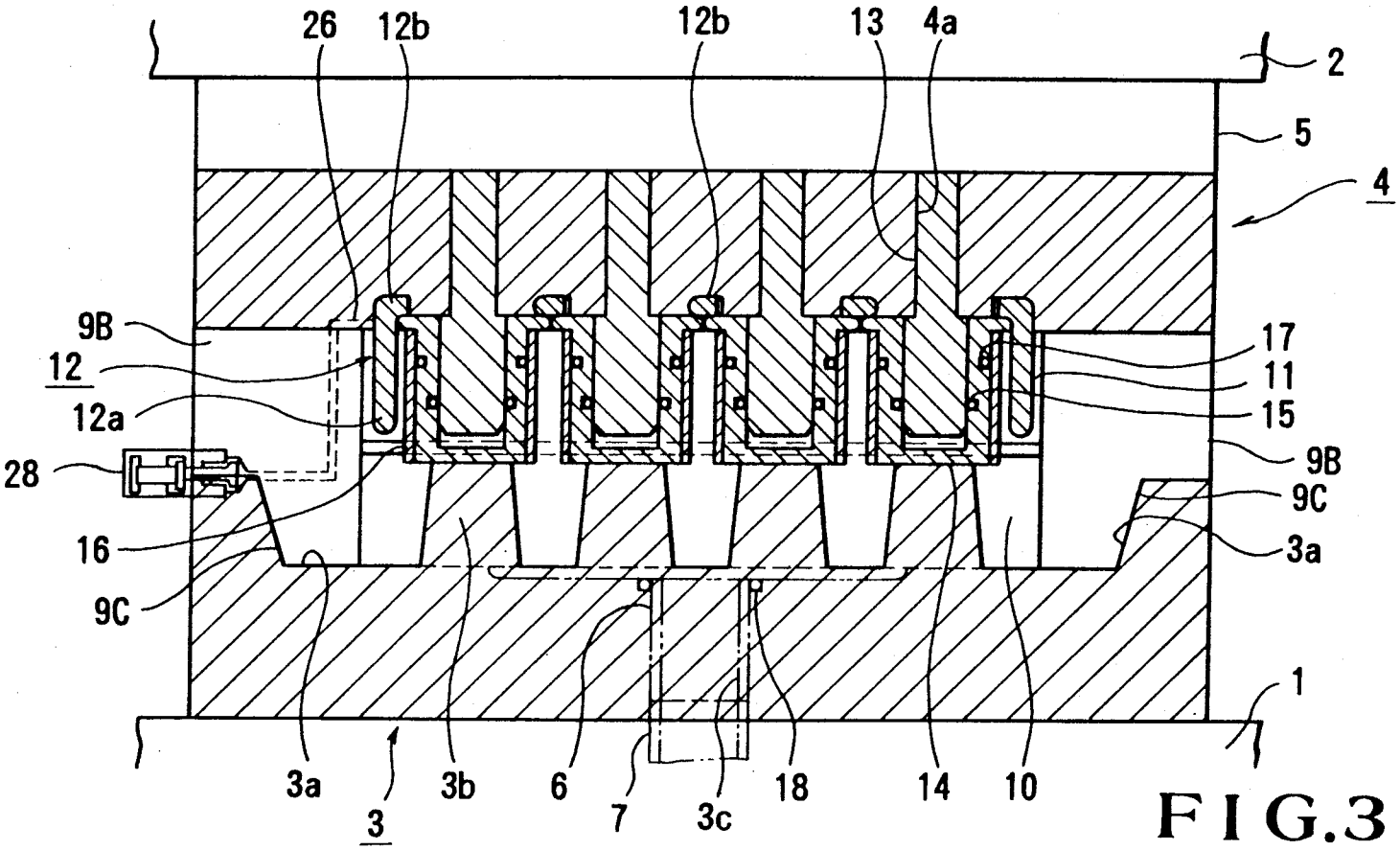
Figure 4:
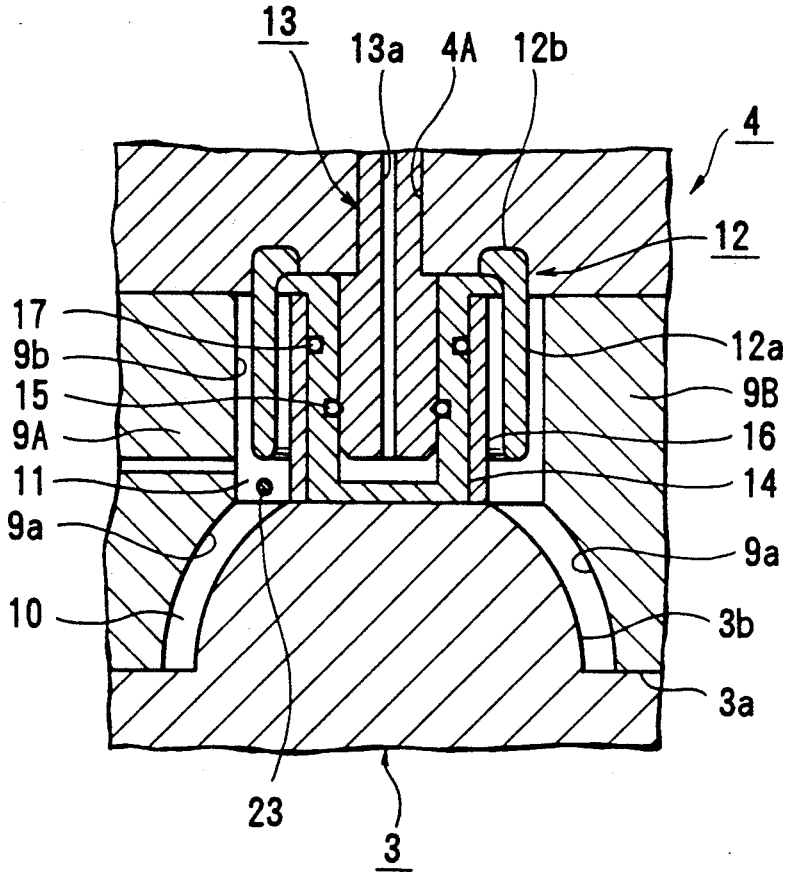
Figure 5:
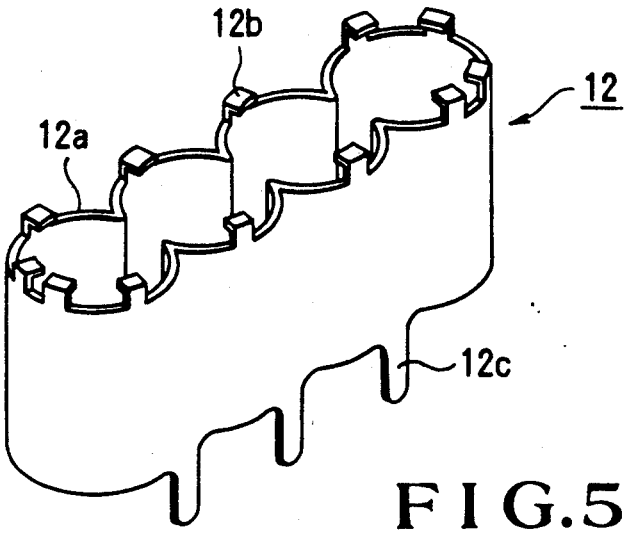
Figure 6:
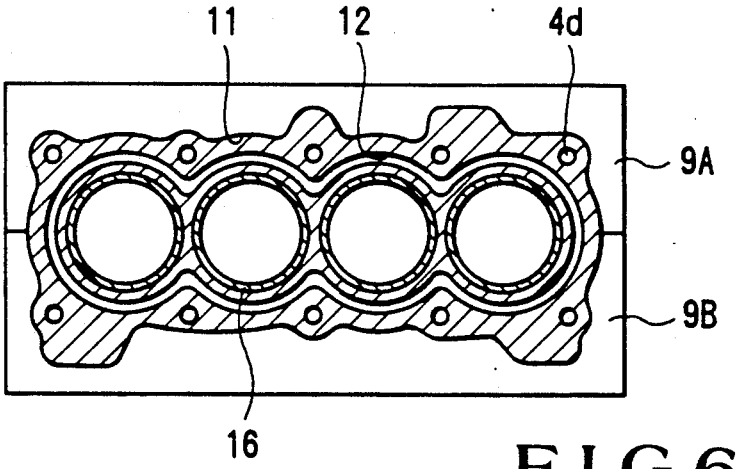
Figure 7:
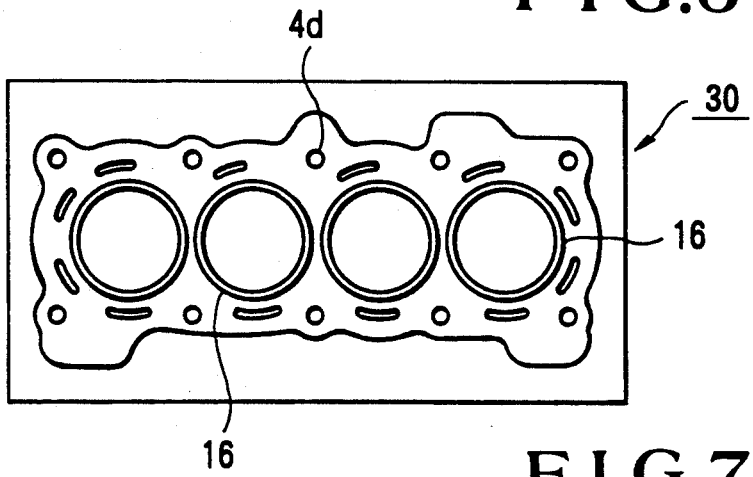

FIGS. 1 to 8*e* show an engine block casting apparatus as a vertical clamping type vertical casting apparatus according to an embodiment of the present invention, in which FIG. 1 is a partially cutaway front view of the entire apparatus, FIG. 2 is a sectional view showing a mold assembly incorporated in the apparatus, FIG. 3 is a longitudinal sectional view of the apparatus along its longitudinal direction, FIG. 4 is an enlarged longitudinal sectional view of the apparatus along its widthwise direction, FIG. 5 is a perspective view of a sand core, FIG. 6 is a cross-sectional view of an engine block, FIG. 7 is a plan view of the engine block, and FIGS. 8*a* to 8*e* are longitudinal sectional views of the casting apparatus so as to explain casting operations.

Referring to FIGS. 1 to 8*e*, tie rods 103 extend upright at four corners of a stationary platen 1 fixed to a machine base 101. A cylinder platen 104, whose flat surface is parallel to that of the stationary platen 1, is supported on the upper end portions of the tie rods 103. The cylinder platen 104 is fixed by nuts 105 threadably engaged with threaded portions of the tie rods 103. A movable platen 2 is supported on the four tie rods 103 so that the tie rods 103 are fitted in holes formed in the movable platen 2. An actuation end of a main ram 107 hydraulically reciprocated in a ram hole formed at the central portion of the cylinder platen 104 is fixed to the movable platen 2. A stationary mold (lower mold) 3 and a movable mold (upper mold) 4, whose flat surfaces are opposite to each other, are respectively mounted on opposite surfaces of the stationary platen 1 and the movable platen 2.

An injection cylinder 110 is aligned with the sleeve hole 3*c* and swingably supported by a bracket 111 in a pit 110A below the stationary platen 1. A plunger 14 is fixed through a coupling 113 to an actuation end of a piston rod 112 hydraulically reciprocated by the injection cylinder 110. A plunger tip 22 is formed at the upper end of the plunger 114.

Reference numerals 115 denote a plurality of ram rods extending on the end face of the injection cylinder 110. These ram rods 115 are reciprocally fitted in ram holes of a sleeve base 117 formed integrally with an injection sleeve 7 at its distal end. The plunger tip 22 at the distal end of the plunger 114 is reciprocally fitted in the inner hole of the injection sleeve 7.

A stationary sleeve 6 is fitted in a sleeve hole 3*c* of the stationary mold 3. A lower end opening of the stationary sleeve 6 serves as a casting port. When an oil pressure acts on the bottom of the ram hole formed in the sleeve base 117, the sleeve base 117 is moved upward so that the upper end face of the injection sleeve 7 is aligned with the sleeve hole 3*c* and brought into contact with the lower end face of the stationary sleeve 6 and is coupled thereto and urged thereby. Cavities 10 and 11 are defined by mating surfaces of the lower and upper molds 3 and 4. The cavity 10 in the lower mold 3 communicates with the stationary sleeve 6 through a gate 18.

Figure 8A:
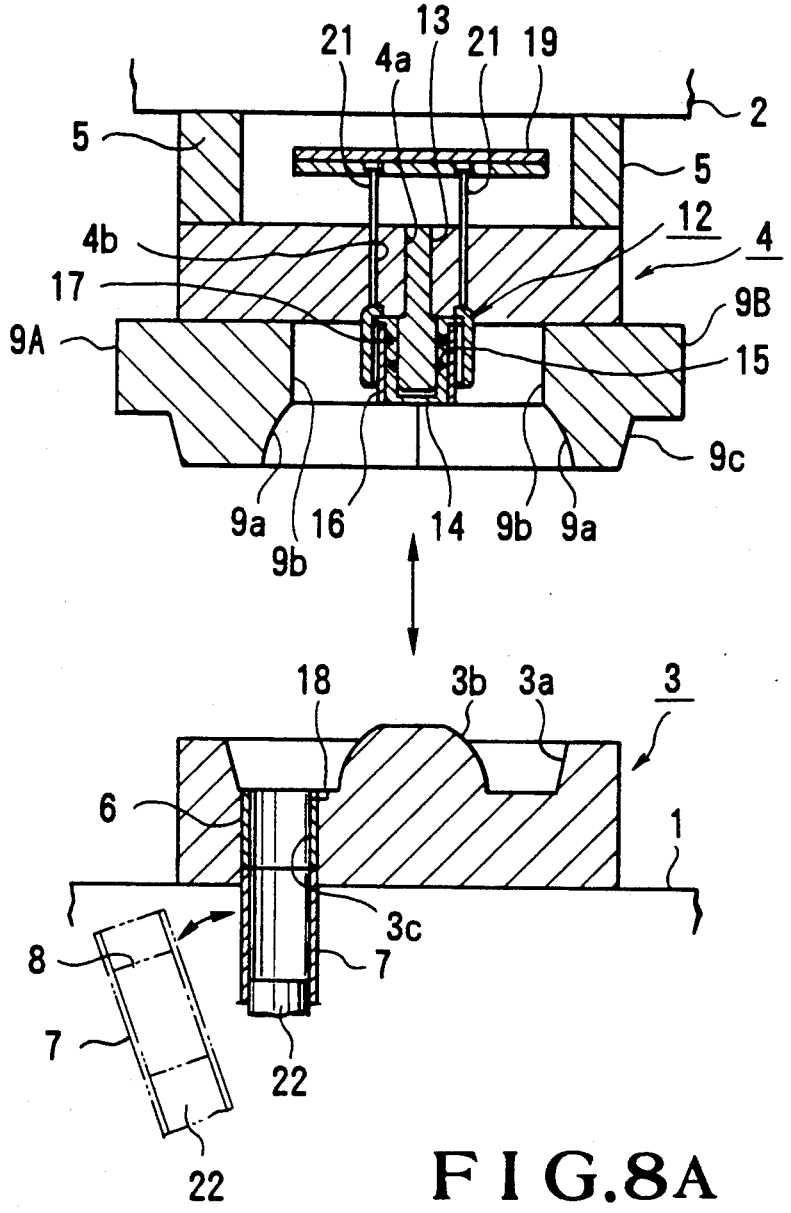
Figure 8B:
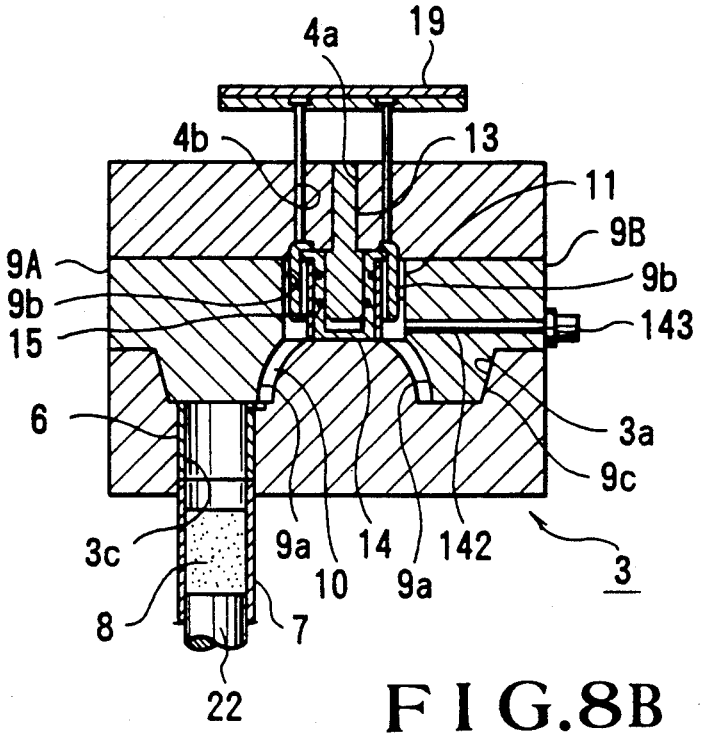

An actuation end of a piston rod 122 of an inclinable cylinder 121 pivoted on the machine base 101 is supported on the injection cylinder 110. When the piston rod 122 is reciprocated in a state wherein the injection sleeve 7 is kept removed from the stationary sleeve 6. Therefore, an injection unit 123 including members from the injection sleeve 110 to the injection sleeve 7 can be inclined between a position indicated by a solid line to a position indicated by an alternate long and two short dashed line in FIG. 1. In the inclined position indicated by the alternate long and two short dashed line in FIG. 1, the molten metal is poured from a laddle 124 to the injection sleeve 7. A recessed portion 3*a* is formed in the lower mold 3. Four blocks 3*b* having an almost semicircular section are located at the central portion of the recessed portion 3*a*. For example, two slide molds 9A and 9B (divided in the circumferential direction in this embodiment) shorter than the molds 3 and 4 are arranged between the lower and upper molds 3 and 4 so that the slide molds 9A and 9B are supported on the upper mold 4. The slide molds 9A and 9B are moved by opening/closing cylinders (not shown) in radially opposite horizontal directions. Notched portions 9*c* each having a tapered longitudinal surface are formed on the outer circumferential surfaces of the lower ends of the slide molds 9A and 9B, as shown in FIGS. 8*a* to 8*e*. During mold clamping, the notched portions 9*c* are engaged with the recessed portions 3*a* of the tapered inner longitudinal surface on the outer circumferential surface of the lower mold 3 and are positioned. The arcuated portions 9*a* for forming the cavity 10 corresponding to the crank case, as shown in FIG. 8*b*, with the blocks 3*b* of the lower mold 3 during closing are formed on the opposite lower halves of the two slide molds 9A and 9B. Opposite surfaces 9*b* for forming the cavity indicated by an hatched area in FIG. 6 during closing are formed in the opposite lower halves of the slide molds 9A and 9B.

As shown in FIG. 5, a destructive sand core 12 for forming a water jacket, as shown in the perspective view of FIG. 5, is supported on the upper mold 4 and set in the cavity 11 during mold clamping. The sand core 12 integrally comprises four cylinder-corresponding portions 12*a* having a cylindrical shape and connected in tandem with each other, a plurality of hooks 12*b* serving as a plurality of mandrel holding portions extending upward from the cylinder-corresponding portions 12*a*, and projections 12*c* serving as a plurality of sand core holding portions extending downward from the cylinder-corresponding portions 12*a*. A mandrel 14 having a cylindrical member with a bottom surface is detachably fitted on a positioning pin 13 inserted, fixed, and extending downward in a pin hole 4*a* of the upper mold 4. The mandrel 14 is supported so that the hooks 12*b* are engaged with the upper end portions of the mandrel 14 to prevent removal of the mandrel 14. A stop ring 15 is inserted between the mandrel 14*a* and the positioning pin 13 and is engaged with a ring groove on the positioning pin 13 while retaining an expansion force to regulate axial movement of the positioning pin 13 with respect to the mandrel 14. A cylindrical liner 16 inserted during molding is fitted on the outer circumferential surface of the mandrel 14 while its axial movement is regulated by a stop ring 17 which retains an expansion force. Referring to FIG. 4, reference numeral 13*a* denotes an air path extending through the central portion of the positioning pin 13. The air path 13*a* is connected to a suction air source (not shown) and draws air from the space formed between the lower end of the positioning pin 13 and the bottom plate of the mandrel 14 and between the outer surface of the positioning pin 13 and the inner circumferential surface of the mandrel 14 to apply a retention force of the mandrel 14 to the positioning pin 13. When the air path 13*a* is formed, the stop ring 15 need not be arranged.

When the stop ring 15 is arranged on the inner circumferential surface of the mandrel 14 and the mandrel 14 is fitted upward on the positioning pin 13, the upper end portion of the inner circumference of the mandrel 14 abuts against a tapered surface of the outer surface lower end portion of the positioning pin 13. At this time, by a slight shock, the cylinder liner 16 may drop by the action of the stop ring 17 mounted on the outer circumferential surface. However, as described above, when vacuum suction is performed through the interior of the positioning pin 13, the stop ring 15 need not be formed. When the mandrel 14 is mounted on the outer surface of the positioning pin 13, no shock acts on the mandrel. As a result, the cylinder liner 16 will not be removed from the outer circumferential surface of the mandrel 14 due to a shock. At the same time, the mandrel 14 can be properly and easily held on the surface of the positioning pin 13. The cavity 11 can be separated into inner and outer spaces by the sand core 12 having the hooks 12*b* engaged with the mandrel 14 so that removal of the sand core 12 can be prevented by the hooks 12*b*. The cavities 10 and 11 communicate with an inner hole of the stationary sleeve 6 by the gate 18.

Reference numerals 19 denote two push plates which are located in a space 137 defined by a spacer 5 and are supported by pistons 20. Push pins 21 whose proximal ends are supported by the push plates 19 are slidably inserted into pin holes 4*a* of the upper mold 4. The push pins 21 cause the push plates 19 to move downward by push cylinders 140 through the pistons 20, so that the push pins 21 are moved downward. A molten metal 8 is solidified in the cavities 10 and 11 to push out an engine block as a product. The plunger tip 22 is moved forward in the injection sleeve 7 and the stationary sleeve 6 by the injection cylinder to inject the molten metal 8.

Reference numeral 23 denotes a main oil gallery mold release pin extending in the horizontal direction below the sand core 12. Reference numeral 142 denotes a squeeze pin extendible to a cavity between the main oil gallery mold release pin 23 and the sand core 12. The pin 142 is reciprocated by a squeeze cylinder 143. Reference numeral 26 denotes a degassing gate; 27, a degassing runner; and 28, a degassing valve. This degassing valve 28 is disclosed in U.S. Pat. Nos. 4,782,886 and 4,489,771. This valve 28 may be closed by an electrical command, but it is closed by an inertia of the molten metal in these prior-art patents.

Figure 8C:
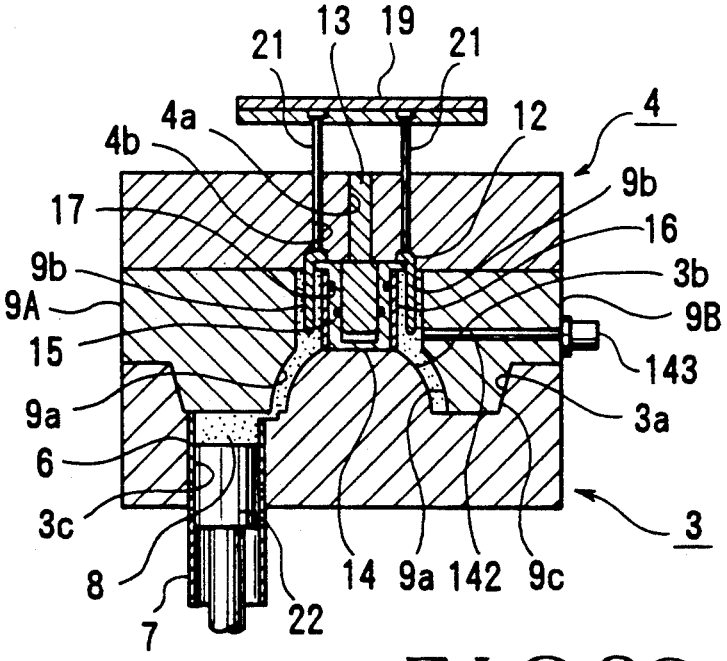

A casting operation of the engine block casting apparatus having the above arrangement will be described below. As shown in FIG. 8*a*, in a state wherein the upper mold 4 is open and at the same time the slide molds 9A and 9B are open, the sand core 12 is supported in the mandrel 14 fitted in the cylinder liner 16, and the mandrel 14 is fitted and supported on the positioning pin 13. The slide molds 9A and 9B are closed by the opening/closing cylinders, and the upper mold 4 is moved by the mold clamping cylinder to perform mold clamping. After the molten metal 8 is injected into the injection sleeve 7 in the inclined state, the injection sleeve 7 is moved upright and then upward and is brought into contact with the stationary sleeve 6. FIG. 8*b* shows this state where the injection sleeve 7 is open to a portion where the lower mold 3 is brought into direct contact with the upper mold 4. As shown in FIG. 8*c*, when the plunger tip 22 is moved forward, the molten metal 8 in the injection sleeve 7 is injected into the cavities 10 and 11 through the stationary sleeve 6 and the gate 18. It takes about 2 to 2.5 seconds to inject the molten metal 8 into the injection sleeve 7 and perform injection. In this case, the molten metal 8 is injected into the cavity 10 serving as the portion corresponding to the crank case and portions except for the sand core 12 in the cavity 11 outside the cylinder liner 16. Casting is performed while the cylinder liner 16 is kept inserted. At the time of injection, an opening between the lower mold 3 and the slide molds 9A and 9B is close to the stationary sleeve 6, and the high-temperature molten metal 8 passes by this opening. This molten metal may enter into the opening. Since the slide molds 9A and 9B and the lower mold 3 are open during mold release, a burr can be easily blown even if it is formed, and no problem is posed. The opening between the upper mold 4 and the slide molds 9A and 9B is far away from the stationary sleeve 6, and the molten metal 8 passing through this opening has a relatively low temperature. Therefore, the low-temperature molten metal tends not to enter into this opening.

During filling of this molten metal, a filling speed (casting speed) can be increased enough to fill with the molten metal the corners of the cavity 10 forming a thin-walled portion (a crank case in this embodiment) of an engine block.

In an initial period of filling the cavity 10 with the molten metal, the casting speed is 0.3 m/sec or more (e.g., 0.4 m/sec).

In a last period of filling the cavity 11 with the molten metal, the casting speed is as low as less than 0.3 m/sec (e.g. 0.2 m/sec). The amount of gas entering into the cavities by the flow of the molten metal can be minimized, and gases produced from the sand core 12 can be efficiently discharged outside the molds.

In a state wherein the cavities are located so that the cylinder head surface faces upward and the crank case side faces downward, since the molten metal is filled from a position below the crank case end to the cavities 10 and 11, the head surface serves as a final filling location of the molten metal. For this reason, the gas in the cavities 10 and 11 is discharged outside through the degassing gate 26, the degassing runner 27, and the degassing valve 28, all of which are located on the head surface side, until filling is almost completed.

Since the head surface faces upward and the crank case side faces downward, a decomposed gas produced from the water jacket destructive sand core 12 located to surround the cylinder bore outer circumferential portion can be discharged from the degassing gate 26 through the interior of the destructive sand core 12 during molten metal filling.

At the end of molten metal filling, the squeeze pin 142 extends to squeeze and eliminate the product cavity.

Figure 8E:
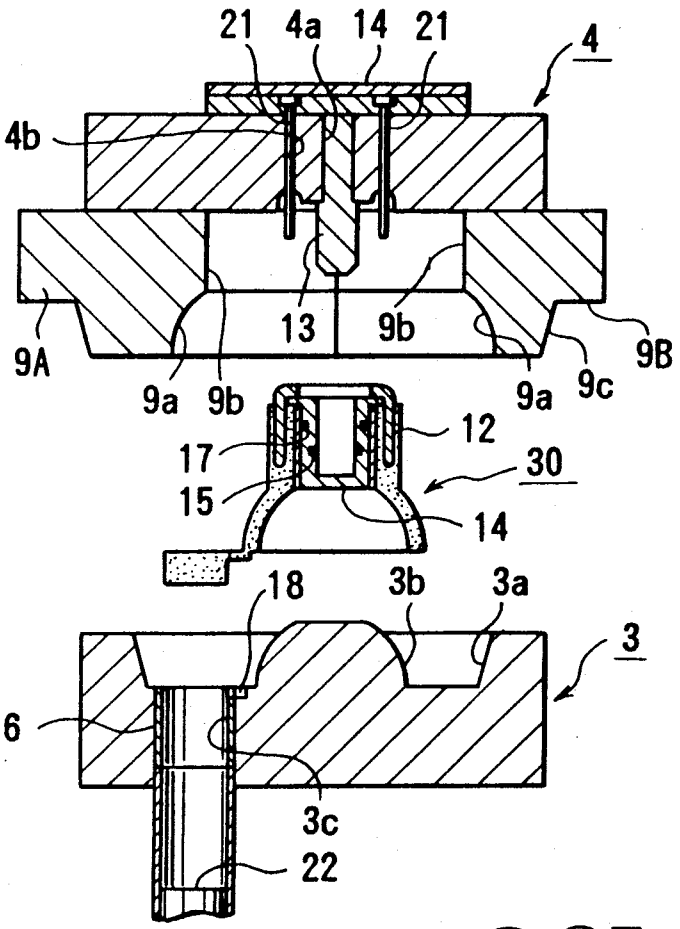
Figure 8D:
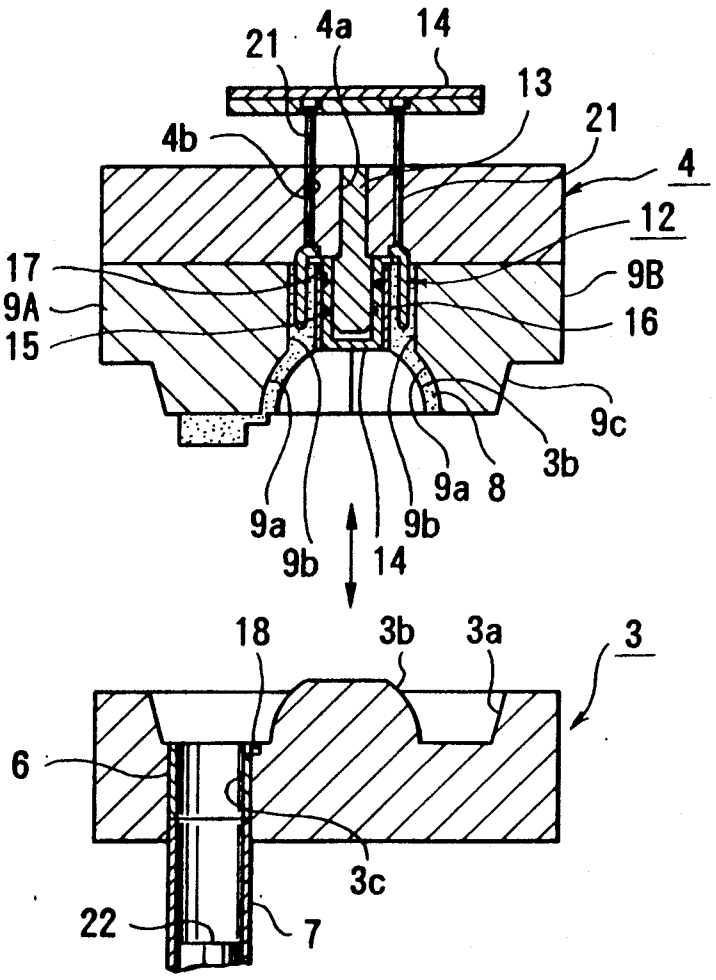

The molten metal 8 in the cavities 10 and 11 is solidified and cooled, the movable platen 2 is moved upward together with the upper mold 4 by the mold clamping cylinder. In this case, the slide molds 9A and 9B supported on the upper mold 4 are also moved upward together with the solidified object of the molten metal as a product. FIG. 8*d* shows this state. As shown in FIG. 8*e*, after the slide molds 9A and 9B are open, the pistons 20 are moved downward by the push cylinders, and the push plates 19 are moved downward together with the push pins 21. A product 30 is pushed out while the push pins 21 and the positioning pin 13 are left. As described above, since the molten metal does not enter into a gap between the upper mold 4 and the slide molds 9A and 9B, the slide molds 9A and 9B can be smoothly moved.

After the pushed product 30 is removed outside the apparatus, the mandrel 14 is removed, and the sand core is destructed by vibrations or the like, thereby removing the sand core 12. Therefore, the engine block having the cooling water circulation jacket and inserted with the cylinder liner 16 is obtained.

Balls urged by compression springs may be used in place of the stop rings 15 and 17.

As is apparent from the above description, according to the present invention, the casting function can be improved, and safety is also improved because no molten metal is sprayed out. In addition, since the molten metal supply sleeve is open to the lower mold surface directly contacting the upper mold. Molten metal injection can be smoothly performed, and product quality can be improved.

Figure 9:
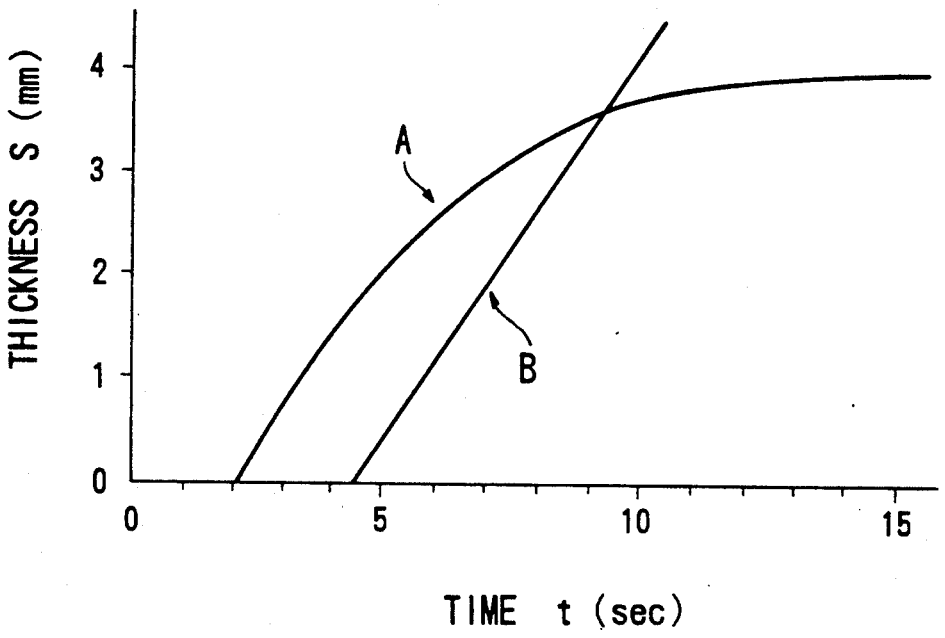
FIG. 9 is a graph showing an experimental result.

The present inventor checked growth states of a semi-molten layer as a layer containing solid and liquid phases upon injection of a molten aluminum alloy in the injection sleeve and a solidified layer obtained by partially converting the semi-molten layer, and test results are shown in FIG. 9. The lapse of time t (sec) from the completion of molten metal injection into the injection sleeve is plotted along the abscissa in FIG. 9, and thicknesses s (mm) of a semi-molten layer A and a solidified layer B, measured from the inner circumferential surface of the injection sleeve to the axial direction are plotted along the ordinate. As is apparent from FIG. 9, with a lapse of about 2 seconds upon completion of molten metal injection, the semi-molten layer A is formed from the inner circumferential surface of the injection sleeve and is gradually grown toward the center. With another lapse of about 2.5 seconds, the semi-molten layer A is gradually converted into the solidified layer B from the inner circumferential surface of the injection sleeve to the center. The solidified layer B is continuously grown, and the entire layer becomes the solidified layer. It is apparent that a pressure is applied within 4.5 seconds upon completion of molten metal injection. Therefore, an inclinable injection apparatus can be realized.

A sand core suitably employed in the present invention is exemplified by a sand core comprising:

(A) a base consisting of sand particles integrally bonded by a binder;

(B) a first film having a thickness of 250 to 5,000 μm and constituted by (a) about 30 to 80 wt% of an inorganic refractory material selected from the group consisting of graphite, mica, fused silica, aluminum oxide, magnesium oxide, carbon black, and a zircon powder, and (b) about 1 to 25 wt% of an inorganic binder selected from the group consisting of colloidal silica, clay, and aminated bentonite; and (C) an additional second surface film having a thickness of 100 to 2,000 μm and constituted by (a) a refractory material selected from the group consisting of fused silica, a zircon powder, and aluminum oxide, (b) a suspension selected from the group consisting of colloidal silica, clay, and bentonite, and (c) an organic compound binder.

This sand core is a high strength die casting sand core having a high pressure resistance, a high humidity resistance, a high resistance to degradation, a high surface permeability, and a mold collapsible property so as to form an under-cut portion of a cast product made of a molten metal in a high-pressure die cast machine.

Another sand core suitably used in the die casting method of the present invention is obtained such that a core sand is added with an additive to form a sand core master having a hydrogen ion index pH of 3.5 or less to form a moldwash layer on the sand core master.

When the pH value of the sand core master is set to be 3.5 or less, and when the sand core master is dipped in a liquid moldwash agent containing colloidal silica, the colloidal silica is gelled at a portion where it contacts the sand core master, so that the viscosity of part of the moldwash agent is increased, and soaking of the moldwash agent into the sand core master can be suppressed. Therefore, a moldwash layer having a uniform thickness can be obtained.

When high-pressure casting such as die casting using this sand core is performed, the molten metal is not permeated into the sand core. When sand is removed from a product upon casting, the sand core can be easily collapsed. All the sand particles can be perfectly and easily removed from the product. Sand is not left on the casting surface of the product after the sand is removed from the inside of the product. Even if such a sand core is used in casting of a product having a very complicated shape such as a cooling jacket portion of closed deck engine block, a satisfactory working condition and a satisfactory product can easily and properly be obtained.

When this sand core is to be manufactured, additives are mixed in the core sand. The core sand consists of a normal casting sand. The additives are, for example, an acid-setting resin and a setting agent. An example of the acid-setting resin is a urea-denatured furan resin, and an example of the setting agent is a compound consisting of about 45 wt% of copper paratoluenesulfonate, about 40 wt% of ethanol, about 5 wt% of ethylene glycol, and about 10 wt% of water.

In this case, 0.5 to 5 parts by weight of the above resin is mixed in 100 parts by weight of the core sand, and the content of the setting agent is 100 wt% or more with respect to the content of the resin, preferably 120 to 200 wt%, and often about 400 wt%.

When the content of the setting agent with respect to the resin or core sand is considerably higher than that in a conventional case, an acidity of a mixture consisting of the core sand and the additives is increased. The pH value of the sand core master is reduced to 3.5 or less. When the content of the setting agent with respect to the resin is a maximum of about 40 wt% as in a conventional case, the pH value of the sand core master is increased to 4.1 to 4.5 or more. In this case, a moldwash layer in the subsequent process cannot be properly formed.

The acid-setting resin may be a resin containing 25 wt% or more of a polymer based on furfuryl alcohol. The setting agent may be a salt consisting of at least one of benzenesulfonic acid, phenolsulfonic acid, toluenesulfonic acid, xylenesulfonic acid, and lower alkylsulfonic acid, and at least one of aluminum, copper, zinc, and iron.

A mixture obtained by mixing the core sand and the additives is blown together with compressed air into a molds having a cavity of a predetermined sand core shape, and a sand core master is formed by a so-called warm box method. The warm box method is to simply heat and harden a sand core box obtained by mixing a binder in a sand material, unlike in a hardox method of hardening a sand core body by using sulfur dioxide. In this case, the temperature of the core mold is set in the range of 90° to 240° C. and preferably 130° to 150° C. The sand core master is heated for about one minute to set it to a predetermined strength.

The sand core master thus formed is dipped in a liquid moldwash agent containing colloidal silica, thereby forming a moldwash layer on the surface of the sand core master.

When this sand core is dipped in the liquid moldwash agent containing colloidal silica, the colloidal silica is reacted with the sand core master portion which contacts the colloidal silica and is gelled, as described above. As a result, the viscosity of the moldwash agent is increased to obtain a sand core having a desired moldwash layer. Soaking of the molding agent into the sand core master can be suppressed, and the moldwash layer having a predetermined thickness is uniformly formed on the surface of the sand core master.

An example of the moldwash agent is an agent obtained by sufficiently stirring 100 parts by weight of a zircon flour, 10 parts by weight of a colloidal silica aqueous solution, and 20 parts by weight of water. The moldwash layer may be constituted by a one- or two-layered structure. In order to improve a mold release property between a product and the moldwash layer, a two-layered structure is preferable. A moldwash agent for forming the second moldwash layer can be, for example, an agent obtained by sufficiently stirring 500 grams of a mica powder, 10 grams of sodium dodecyl benzenesulfonate as a wetting agent, and 1 gram of octyl alcohol as an anti-forming agent.

The core manufactured by the method as described above was set in a cavity formed by the molds, a molten aluminum alloy (ADC 12) of 700° C. was charged at a casting pressure of 920 kg/cm$^2$ and a plunger speed of 0.1 mm/sec by using a 250-ton squeeze cast machine. After casting, a product was released from the molds and the sand was removed from the product. The sand core of the present invention was perfectly destroyed, and the sand could be easily and perfectly removed. The casting surface of the product was smooth and metal penetration of the molten aluminum alloy was not found. When a conventional warm box core dipped in the moldwash agent in a manner similar to the one described above was used, a lot of metal penetration portions were found. The casting surface of a portion even free from metal penetration was not smooth, and a three-dimensional pattern was found as if the surface shape of the core itself was transferred.

Another core is exemplified by a core containing a setting agent containing a catalyst substance consisting of a granular refractory aggregate, an acid-setting resin, and a salt of a weak base and a salt of an aliphatic sulfonic acid and/or an aromatic sulfonic acid, the catalyst substance falling within the range of 40 wt% (exclusive) to 400 wt% (inclusive) of the acid-setting resin.

Since the content of the setting catalyst falls within the range of 40 wt% to 400 wt% of the acid-setting resin, soaking of the moldwash agent into the core itself can be suppressed, and a moldwash layer having an appropriate thickness is formed on the surface of the core. When the time limit of use of the mixture prior to thermo-setting, and the cost of the mixture are taken into consideration, the content of the setting catalyst preferably falls within the range of 45 to 75 wt%. Even if the content of the setting catalyst exceeds 400 wt% of the acid-setting resin, only the cost is increased, and the effect is not enhanced. Therefore, the upper limit of the content of the catalyst was 400 wt%.

According to this core, since the content of the setting catalyst falls within the range of 40 wt% to 400 wt% with respect to the acid-setting resin, a core capable of forming a moldwash layer on the core suitable for high-pressure casting can be obtained by the warm box method. That is, soaking of the moldwash agent into the core itself can be suppressed, and a moldwash layer having an appropriate thickness can be formed on the surface of the core.

When die casting is performed using this core, molten metal penetration into the core and damage to the core can be prevented. In addition, when the product is removed from the molds, the core inside the product can be easily destroyed by applying a small vibration to the product. The core can be easily and properly removed from the product without leaving the core sand particles on the inner surface of the product. The inner casting surface can also be made smooth.

A setting agent was mixed in 100 parts by weight of casting sand so that the setting agent contained 1.5 parts by weight of a urea-denatured furan resin and the catalyst substance in a content shown in Table 1 with respect to the resin weight. The resultant mixture was blown together with compressed air into the molds preheated to 130° C. and was filled in the molds. The mixture was sintered for 50 seconds to form a core. This core was cooled to room temperature, dipped in the following fist moldwash agent and dried to form a first moldwash agent. At this time, the slice of the core was observed to measure a soaking depth of the moldwash agent from the surface of the core and a thickness of a moldwash layer formed on the surface of the core.

| <First Moldwash Agent> | |
|---|---|
| Zircon flour (average grain size: 8 μm) | 100 parts by weight |
| 30% Colloidal silica aqueous solution | 10 parts by weight |
| Water | 20 parts by weight |

TABLE 1

| Content of Catalyst | Depth of Soaking | Thickness of Moldwash Layer |
|---|---|---|
| 45 wt % | about 1 mm | 0.1–0.2 mm |
| 75 wt % | 0.5 mm or less | 0.3 mm |

The core was then dipped in the following second moldwash agent to form a second moldwash layer.

| <Second Moldwash Agent> | |
|---|---|
| 3% aqueous phenol resin solution | 1000 cc |
| Mica powder (300 mesh or less) | 500 g |
| Wetting agent | 10 g |
| Anti-forming agent | 1 g |

The core manufactured by the method as described above was set in a cavity formed by the molds, a molten aluminum alloy (ADC 12) of 700° C. was charged at a casting pressure of 920 kg/cm$^2$ and a plunger speed of 0.1 mm/sec by using a 250-ton squeeze cast machine. After casting, a product was released form the molds and the sand was removed from the product. The sand core of the present invention was perfectly destroyed, and the sand could be easily and perfectly removed. The casting surface of the product was smooth and metal penetration of the molten aluminum alloy was not found.

Consequently, by using the inclinable molten metal supply apparatus and the core manufactured by the above method, casting can be started within about 4 seconds upon completion of injection of the molten metal into the injection sleeve, and the molten metal is compressed at a high casting pressure of 300 kg/cm$^2$ or more, thereby solving the conventional problems.

According to the die casting method of the present invention as described above, since a period required from supply of the molten metal into the injection sleeve to the start of injection is shortened, a solidified layer is not formed in the outer portion of the molten metal. At the time of injection, a solidified layer will not remove the surface coating layer of the destructive core. In addition, since the casting pressure can be set high, the cavities in the product can be collapsed, thereby properly obtaining a high-quality cast product.

In this casting operation, since the slide molds and the sand core are supported by the upper mold which is brought into contact with a molten metal having a relatively low temperature, the molten metal tends not to enter into a gap between mold split surfaces of the upper mold and the slide molds. Therefore, the burrs are not formed or the molten metal is not sprayed out.

Even if the molten metal enters into a gap between the molt split surfaces of the lower mold and the slide molds and is solidified into a burr, the slide molds are moved upward together with the upper mold and the product and are largely separated from the lower mold upon mold release, so that the burr is moved upward together with the product and can be easily removed. Even if a burr is partially removed and is left on the lower mold, the burr is exposed on the upper surface of the lower mold in air upon mold release. This burr can be easily removed by an air blow. In addition, since casting is performed at a high pressure of 300 kg/cm$^2$, formation of a cavity can be prevented, and a highly reliable product can be obtained.

Figure 11:
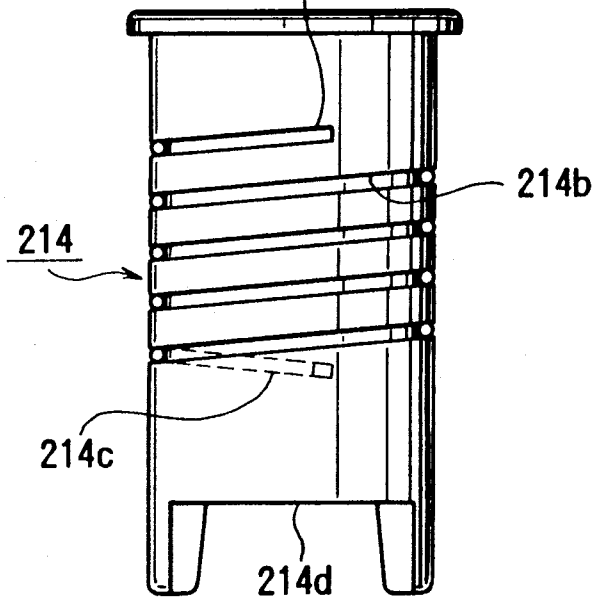
FIG. 11 is a front view showing the mandrel.
Figure 10:
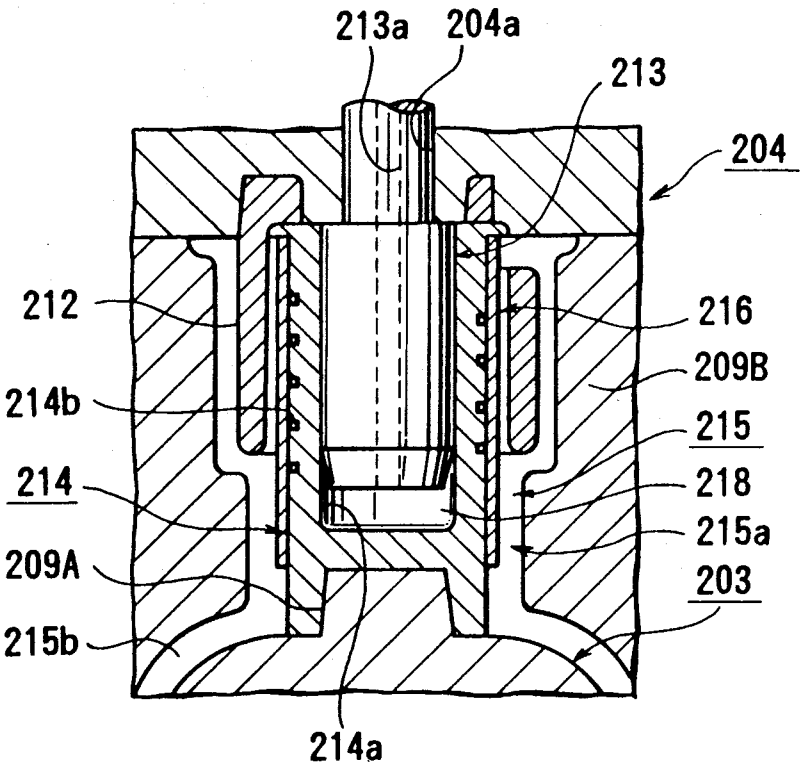
FIG. 10 is a longitudinal sectional view of a mold assembly showing a modification of a mandrel.
Figure 14:
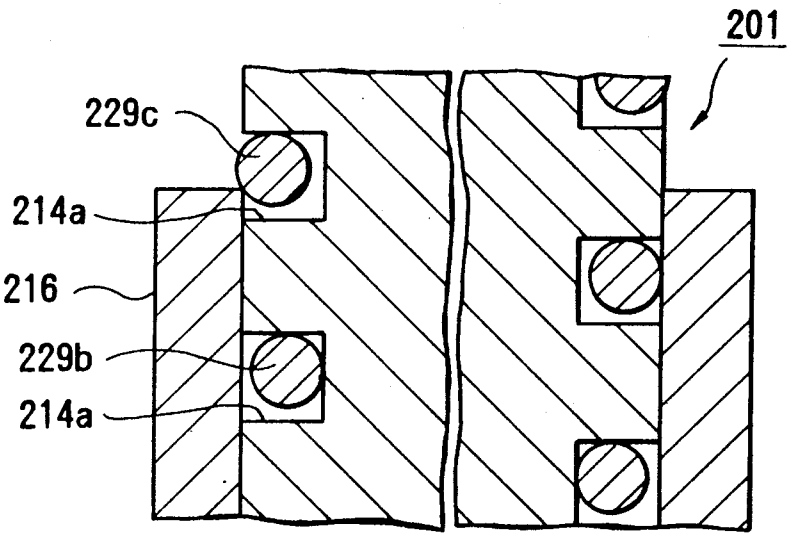
FIG. 14 is an enlarged longitudinal sectional view of the mandrel.
Figure 12:
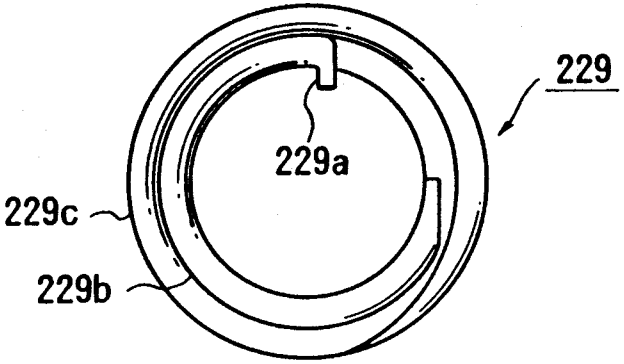
FIG. 12 is a front view showing a coil spring.
Figure 13:
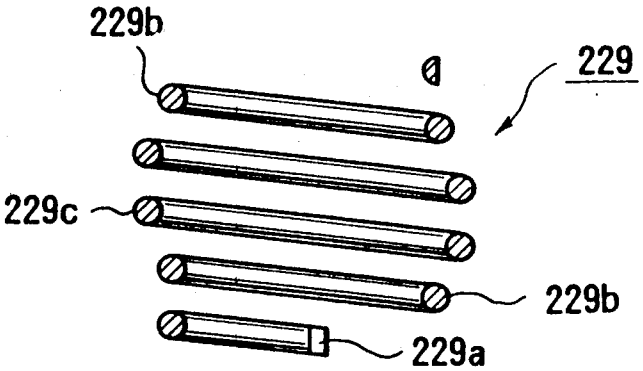
FIG. 13 is a longitudinal sectional view of the coil spring.

FIGS. 10 to 14 show a modification of the mandrel having a cylinder line according to the present invention. FIG. 10 is a longitudinal sectional view of a mold assembly, FIG. 11 is a front view of the mandrel, FIG. 12 is a plan view of a coil spring, FIG. 13 is a longitudinal sectional view of the coil spring, and FIG. 14 is an enlarged longitudinal sectional view of the mandrel.

Referring to FIGS. 10 to 14, a spiral groove **214*b* is formed on the outer circumferential surface of a mandrel 214 at a plurality of pitches in the axial direction. A coil spring 229 having a plurality of turns is fitted in the spiral groove 214*b*. A cylinder liner 216 serving as a cylindrical insert member inserted during casting is mounted on the outer circumferential surface of the mandrel 214. In this modification, a start end portion 214*c* corresponding to the start end of the coil spring 229 in the groove 214*b* extends to an opening end 214*d* of the mandrel 214. After the coil spring 229 is mounted, an extension of the groove 214*b* is paved so as to eliminate the groove. One end of the coil spring 229 is fixed such that a bent portion 229*a* formed at the end of the start portion of the cylinder liner 216 is fitted in a hole formed in the mandrel 214**. The other end of the coil spring 229 is a free end. The end portion of the groove 214*b* which corresponds to the free end portion of the coil spring 229 is longer than the free end portion of the coil spring 229 in consideration of elongation of the coil spring 229. In this apparatus, the outer diameter of the coil spring 229 is determined as follows. A portion of the coil spring 229 from the start end of the cylinder liner 216 to a portion of at least a ⅝ pitch is constituted by a small-diameter portion 229*b* having a diameter smaller than that of the outer circumferential surface of the mandrel 214 which is defined by the groove 214*b*. The remaining portion continuous with this small-diameter portion 229*b* has an outer diameter slightly smaller than that of the mandrel 214. In this modification, the end portion of the coil spring 229 at a position opposite to the small-diameter portion 229*b* is also constituted by a small-diameter portion. However, this portion need not be a small-diameter portion.

A casting operation of a die cast machine having the above insert holding unit will be described below. In a state wherein an upper mold 204 is open and slide molds 409A and 409B are open, a sand core 212 is supported in the mandrel 214 having the groove 214*b* fitted with the coil spring 229. The mandrel 214 was fitted on and supported by a positioning pin 213, and the cylinder liner 216 serving as a cylindrical insert member is mounted on the outer circumferential surface of the mandrel 214 through the coil spring 229. During this mounting, as shown in FIG. 14, the coil spring 229 is coaxial with the mandrel 214. The small-diameter portion 229*b* is in contact with the bottom surface of the groove 214*a*, and a large-diameter portion 229*c* is separated from the bottom surface of the groove 214*a* and the outer portion of the large-diameter portion 229*c* slightly extends outward from the groove 214*a*, so that the cylinder liner 216 can be easily mounted. When the cylinder liner 216 is inserted deeper from a position indicated in FIG. 14, the diameter of the large-diameter portion 229*c* of the coil spring 229 is increased, so that axial movement of the cylinder liner 216 with respect to the mandrel 214 is restricted, and the cylinder liner 216 is thus fixed.

As is apparent from the above description, according to the present invention, when the cylinder liner is to be mounted on the mandrel, it can be easily mounted thereon without being interfered by the coil spring, thereby improving workability. In this case, the sand core is not damaged, and the sand left inside the product can be perfectly removed, thereby obtaining a product having a desired shape and improving the product quality.

Figure 15:
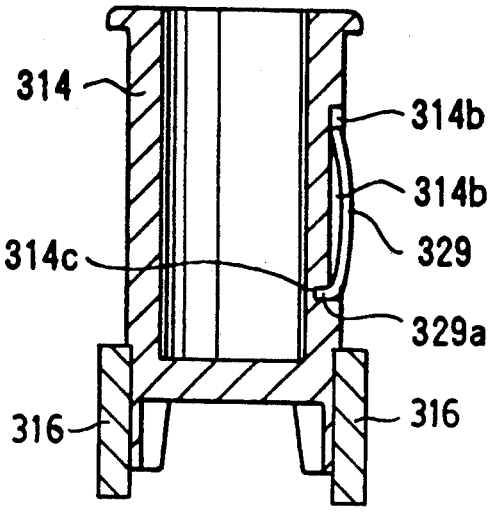
FIG. 15 is a longitudinal sectional view showing another modification of the mandrel.

FIG. 15 shows another modification of the mandrel. One axial groove or two to four axial grooves 314*b* are formed in part of the outer circumferential surface of a mandrel 314. An arcuated spring 329 is inserted into each groove 314*b*. A cylinder liner 316 serving as a cylindrical insert member is mounted on the outer circumferential surface of the mandrel 314 at the time of casting.

The insertion start end of the spring 329 is bent to constitute a bent piece 329*a*, and the bent piece 329*a* is fixed in a hole 314*c* formed in the insert start side of the groove 314*b* by welding, shrink fit, a mounting agent, or caulking. The outer surface of the insertion start side of the spring 329 is arcuated or tapered at a position inward from the outer circumferential surface of the mandrel 314. The outer surface of the spring 329 which continues from this arcuated or tapered portion is located outward from the outer circumferential surface of the mandrel 314. A portion of the spring 329 which is outward from the outer circumferential surface of the mandrel 314 is urged into the groove 314*b* by the cylinder liner 316 mounted on the outer circumferential surface of the mandrel 314.

The bent piece 329*a* serving as the insertion start end of the spring 329 is fixed, but the other end of the spring 329 is a free end. The end portion of the groove 314*b* corresponding to the free end portion of the spring 329 is longer than the free end portion of the spring 329 in consideration of elongation of the spring 329.

A casting operation of a die cast machine having the above insert holding unit will be described below. In a state wherein an upper mold 304 is open and slide molds 309A and 309B are open, a sand core 312 is supported in the mandrel 314 having the groove 314*b* fitted with the spring 329. The mandrel 314 was fitted on and supported by a positioning pin 313, and the cylinder liner 316 serving as a cylindrical insert member is mounted on the outer circumferential surface of the mandrel 314 through the spring 329. During this mounting, as shown in FIG. 15, the outer portion of the spring 329 on the mounting side of the cylinder liner 316 is retracted inside from the outer circumferential surface of the mandrel 324. The central back portion of the spring 329 slightly extends outward from the outer circumferential surface of the mandrel 314. Therefore, the cylinder liner 316 can be easily mounted on the outer circumferential surface of the mandrel 314. When the cylinder liner 316 is mounted deeper, the free end of the spring 329 can be moved so that the back portion is urged inward by the cylinder liner 316. Therefore, axial movement of the cylinder liner 316 is restricted with respect to the mandrel 314, so that the cylinder liner 316 is fixed.

Figure 16:
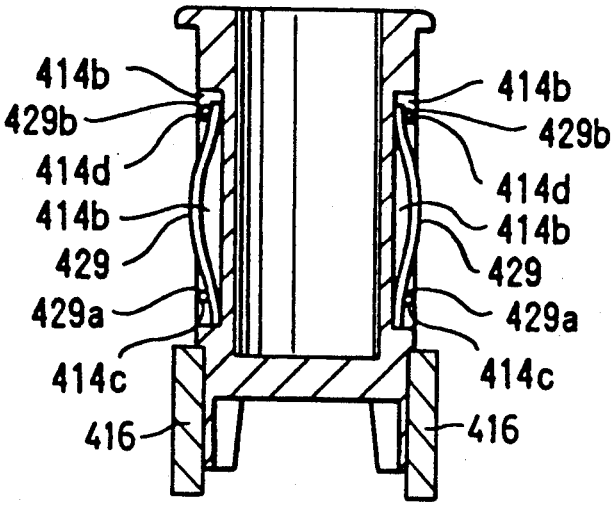
FIG. 16 is a longitudinal sectional view showing still another modification of the mandrel.

FIG. 16 shows still another modification of the mandrel. A relatively deep axial first groove (one part of the outer circumferential surface of a mandrel 414 serving as an insert holder. At the same time, circumferential second grooves 414*c* and 414*d* shallower than the first groove 414*b* are formed near end portions of the first groove 414*b* along the outer circumferential surface of the mandrel 414. An arcuated spring 429 is fitted in the first groove 414*b*, and stop rings 429*a* and 429*b* for stopping the ends of the spring 429 are fitted in the second grooves 414*c* and 414*d* so that outer portions of the stop rings 429*a* and 429*b* do not extend outward from the outer circumferential surface of the mandrel 414. Both end portions of the arcuated spring 429 are in contact with the bottom surface of the first groove 414*b*, and the central back portion of the spring 429 slightly extends outward from the outer circumferential surface of the mandrel 414. The central back portion of the spring 429 is pushed inward in the first groove 414*b* by the cylinder liner 416, so that the central back portion of the spring 429 urges outward the cylinder liner 416, and the cylinder liner 416 is held on the mandrel 414.

The insertion start end of the spring 429 may be fixed by a stop ring 429*a*. However, the other end of the spring 429 is set to be a free end. Although the other end is urged by the spring 429*b*, axial movement of the spring is allowed. In this case, when the cylinder liner 416 is mounted on the mandrel 414, the free end of the spring 429 is moved, so that the end portion of the first groove 414*b* is deeper than the position of the free end of the spring 429.

What is claimed is:

1. A method of casting an engine block, comprising the steps of:

causing a core holding portion supported by and below an open upper mold located above a lower mold fixed on a stationary platen to hold a water jacket formation destructive core surrounding a cylinder bore formation portion;

closing slide 9A, 9B molds which are divided in a circumferential direction, are located between said upper mold and said lower mold, and are supported by said upper mold to be opened/closed in a horizontal direction;

performing mold clamping upon downward movement of said upper mold; and injecting a molten metal, at a high casting pressure of not less than 300 kg/cm$^2$, from a molten metal injection sleeve open to a portion at which said lower mold is brought into direct contact with said upper mold.

2. A method according to claim 1, wherein the step of injecting the molten metal comprises the step of injecting the molten metal to surround a cylinder liner while said cylinder liner is held by a cylinder holding unit on a cylinder liner holding portion located below said upper mold.

3. A method according to claim 1, wherein the step of injecting the molten metal comprises the step of injecting the molten metal by using a mold which has a degassing path for discharging a gas from a mold cavity to an outside and is located on a cylinder head contact surface side above the engine block.

4. A method according to claim 1, wherein the step of injecting the molten metal comprises the step of starting casting within four seconds upon completion of molten metal pouring into said injection sleeve.

5. A method according to claim 1, wherein the destructive core comprises a core formed such that additives are mixed in a core sand to form a sand core master having a hydrogen ion index pH of 3.5 or less, and a moldwash layer is formed on a surface of the sand core master.

6. A method according to claim 1, wherein said destructive core comprises a core which contains a catalyst substance falling within a range of 40 wt% to 400 wt% of an acid-setting resin and which has a moldwash layer having a predetermined thickness on the surface of said core.

7. A method according to claim 1, wherein the step of injecting the molten metal comprises the step of injecting the molten metal at a high casting speed in an initial period of casting and at a low casting speed in a last period of casting in the mold cavity.

8. An apparatus for casting an engine block, comprising:

a lower mold fixed on a stationary platen;

an upper mold located above said lower mold, supported by a movable platen, and vertically moved together with said movable platen;

slide molds located between said upper mold and said lower mold, divided in a circumferential direction, opened/closed in a horizontal direction, and arranged to be slidable on said upper mold;

a vertical casting injection unit for injecting a molten metal in a mold cavity;

a destructive core held in a core holding portion supported by and below said upper mold; and an injection sleeve movable from a position below said lower mold to a position in contact with said lower mold where said injection sleeve is open to a portion at which said lower mold is brought into direct contact with said upper mold.

9. An apparatus according to claim 8, wherein said injection unit comprises an injection unit capable of compressing the molten metal in the mold cavity at a high casting pressure of not less than 300 kg/cm$^2$.

10. An apparatus according to claim 8, wherein a degassing path is formed on a cylinder head contact side above the engine block to discharge a gas from the mold cavity to an outside.

11. An apparatus according to claim 8, further comprising a cylinder liner held by a cylinder liner holding unit on a cylinder liner holding portion below said upper mold.

12. An apparatus according to claim 11, wherein said cylinder line holding unit comprises a columnar or cylindrical cylinder liner holding portion in which a spiral groove is axially formed at a plurality of pitches on an outer circumferential surface of said columnar or cylindrical cylinder liner holding portion, and a coil spring having a plurality of turns is fitted in said spiral groove, so that an end of said coil spring corresponding to a mounting start side of said cylinder liner is held by part of said cylinder liner holding portion, a portion of said coil spring from the end on the mounting start portion of said cylinder liner to at least a ⅜-pitch portion has an outer diameter smaller than that of an outer circumferential surface defining said groove of said cylinder liner holding portion to constitute a small-diameter portion, and a remaining portion continuous with said small-diameter portion has an outer diameter slightly larger than that of said cylinder liner holding portion.

13. An apparatus according to claim 11, wherein said cylinder liner holding apparatus comprises a cylinder liner holding unit having an axial groove formed in part of the outer circumferential surface of a cylinder liner holder, and an arcuated spring is fitted in the axial groove, so that an end of said spring on a mounting start side of said cylinder liner is fixed at part of the cylinder liner holder, an outer surface of said spring on the mounting start side of said cylinder liner is constituted by an arcuated or tapered portion located inward from the outer circumferential surface of the cylinder liner holder, and an outer surface of a portion continuous with said arcuated or tapered portion is located outward from the outer circumferential surface of the cylinder liner holder and is urged by said cylinder liner to retract the outer surface of said portion continuous with said arcuated or tapered portion inward in the groove.

14. An apparatus according to claim 11, wherein a bottom plate and an inner circumferential surface of said cylinder liner holding portion are drawn toward a positioning pin extending downward from said upper mold by a vacuum provided in an air path extending through said positioning pin, thereby applying a retention force with respect to said positioning pin.

15. An apparatus according to claim 8, wherein said vertical casting injection unit comprises an inclinable injection unit for immediately starting a casting operation while said injection sleeve which has received the molten metal at the end of mold clamping is aligned with a sleeve hole of said lower mold.

16. A method of casting an engine block, comprising the steps of:

causing a core holding portion supported by and below an open upper mold located above a lower mold fixed on a stationary platen to hold a water jacket formation destructive core surrounding a cylinder bore formation portion;

closing slide molds which are divided in a circumferential direction, are located between said upper mold and said lower mold, and are supported by said upper mold to be opened/closed in a horizontal direction;

performing mold clamping upon downward movement of said upper mold; and injecting a molten metal, at a high casting pressure of not less than 300 kg/cm$^2$, from a molten metal injection sleeve movable from a position below said lower mold to a position in contact with said lower mold where said injection sleeve is open to a portion at which said lower mold is brought into direct contact with said upper mold.

17. An apparatus for casting an engine block, comprising:

a lower mold fixed on a stationary platen;

an upper mold located above said lower mold, supported by a movable platen, and vertically moved together with said movable platen;

slide molds located between said upper mold and said lower mold, divided in a circumferential direction, opened/closed in a horizontal direction, and arranged to be slidable on said upper mold;

a vertical casting injection unit for injecting a molten metal in a mold cavity;

a destructive core held in a core holding portion arranged below said upper mold;

an injection sleeve open to a portion at which said lower mold is brought into direct contact with said upper mold; and a cylinder liner held by a cylinder liner holding unit comprising a columnar or cylindrical cylinder liner holding portion having a spiral groove axially formed at a plurality of pitches on an outer circumferential surface of said columnar or cylindrical cylinder liner holding portion, and a coil spring having a plurality of turns fitted in said spiral groove so that an end of said coil spring corresponding to a mounting start side of said cylinder liner is held by part of said cylinder liner holding portion, with said coil spring having a first portion form the end of the mounting start portion of said cylinder liner to at least a $\frac{3}{2}$-pitch portion, said first portion having an outer diameter smaller than that of an outer circumferential surface defining said groove of said cylinder liner holding portion to constitute a small-diameter portion, said coil spring further having a remaining portion continuous with said small-diameter portion, said remaining portion having an outer diameter slightly larger than that of said cylinder liner holding portion.

18. An apparatus for casting an engine block, comprising:

a lower mold fixed on a stationary platen;

an upper mold located above said lower mold, supported by a movable platen, and vertically moved together with said movable platen;

slide molds located between said upper mold and said lower mold, divided in a circumferential direction, opened/closed in a horizontal direction, and arranged to be slidable on said upper mold;

a vertical casting injection unit for injecting a molten metal in a mold cavity;

a destructive core held in a core holding portion arranged below said upper mold;

an injection sleeve open to a portion at which said lower mold is brought into direct contact with said upper mold; and a cylinder liner holding apparatus for holding a cylinder liner below said upper mold, said cylinder liner holding apparatus comprising a cylinder liner holding unit having an axial groove formed in part of the outer circumferential surface of a cylinder liner holder, and an arcuated spring fitted in the axial groove so that an end of said spring on a mounting start side of said cylinder liner is fixed at part of the cylinder liner holder, with an outer surface of said spring on the mounting start side of said cylinder liner having an arcuated or tapered portion located inward from the outer circumferential surface of the cylinder liner holder and an outer surface of a portion continuous with said arcuated or tapered portion located outward from the outer circumferential surface of the cylinder liner holder so that said outer surface is urged by said cylinder liner to retract the outer surface of said portion continuous with said arcuated or tapered portion inward in the groove.

19. An apparatus for casting an engine block, comprising:

a lower mold fixed on a stationary platen;

an upper mold located above said lower mold, supported by a movable platen, and vertically moved together with said movable platen;

slide molds located between said upper mold and said lower mold, divided in a circumferential direction, opened/closed in a horizontal direction, and arranged to be slidable on said upper mold;

a vertical casting injection unit for injecting a molten metal in a mold cavity;

a destructive core held in a core holding portion arranged below said upper mold;

an injection sleeve open to a portion at which said lower mold is brought into direct contact with said upper mold; and a cylinder liner held by a cylinder liner holding unit on a cylinder liner holding portion below said upper mold, with a bottom plate and an inner circumferential surface of said cylinder liner holding portion drawn toward a positioning pin extending downward form said upper mold by a vacuum provided in an air path extending through said positioning pin to apply a retention force with respect to said positioning pin.

* * * * *

UNITED STATES PATENT AND TRADEMARK OFFICE

CERTIFICATE OF CORRECTION

PATENT NO. : 5,178,202

DATED : January 12, 1993

INVENTOR(S) : Dannoura et al.

It is certified that error appears in the above-identified patent and that said Letters Patent is hereby corrected as shown below:

In claim 17 in column 19 at line 48 replace "form the end" with --from the end--;

In claim 19 in column 20 at line 57 replace "downward form said' with --downward from said--.

Signed and Sealed this

Fifth Day of September, 1995

*Attest:*

Bruce Lehman

BRUCE LEHMAN

*Attesting Officer*

*Commissioner of Patents and Trademarks*